United States Patent [19]

Allesch et al.

[11] 4,101,037

[45] Jul. 18, 1978

[54] FOLDABLE ROTARY CLOTHES HOIST

[76] Inventors: Ernst Allesch, 56 Port Arthur St., Lyons, Canberra, Australia 2606; Nathan Bank, 18 McCormack St., Curtin, Canberra, Australia 2605

[21] Appl. No.: 751,063

[22] Filed: Dec. 13, 1976

[30] Foreign Application Priority Data

Oct. 19, 1976 [AU] Australia ..... 7785/76

[51] Int. Cl.[2] ..... A47F 5/02

[52] U.S. Cl. ..... 211/167; 211/197

[58] Field of Search ..... 211/119.01, 163, 165–168, 211/174, 197

[56] References Cited

U.S. PATENT DOCUMENTS

| | | | |
|---|---|---|---|
| 350,237 | 10/1886 | Fleck | 211/167 X |
| 621,130 | 3/1899 | Peyton | 211/174 |
| 984,556 | 2/1911 | Gehrke | 211/165 |
| 2,452,246 | 10/1948 | Kronhaus | 211/197 X |
| 2,794,556 | 6/1957 | Lego | 211/197 |
| 2,951,595 | 9/1960 | Pierie | 211/197 |

FOREIGN PATENT DOCUMENTS

| | | | |
|---|---|---|---|
| 9,917 | 10/1932 | Australia. | |
| 201,925 | 12/1955 | Australia. | |
| 1,128,391 | 4/1962 | Fed. Rep. of Germany | 211/196 |

*Primary Examiner*—Roy D. Frazier
*Assistant Examiner*—Terrell P. Lewis
*Attorney, Agent, or Firm*—Fleit & Jacobson

[57] ABSTRACT

A rotary clothes hoist which is foldable and may also function as a sun umbrella is described. The hoist has a plurality of extending arms which are held in position by tensioning members and each arm has a clothes line attached. The hoist is arranged for adjustable and removable insertion in a socket thereby facilitating its removal and allowing utilization of the area for other activities.

8 Claims, 8 Drawing Figures

FOLDABLE ROTARY CLOTHES HOIST

FIELD OF THE INVENTION

This invention relates to a new rotary clothes hoist which may also be used as a sun umbrella. In particular the invention relates to a clothes hoist which is collapsible or foldable and thus can be stored away when not in use.

DESCRIPTION OF THE PRIOR ART

Rotary clothes hoists which have a number of radially projecting arms supported from a vertical central stem with clothes lines positioned between the arms are known. The clothes lines are attached to adjacent arms in a concentric polygonal array. The more common type of these hoists is not collapsible and consequently suffers the disadvantage that it cannot be removed and thus requires a special area. This disadvantage has been recognized and accordingly a collapsible hoist has been devised which is removable when not in use and which when required may be easily assembled. Both these types of hoists have the disadvantage that the drying effect of a current of air is lessened because of the disposition of the line. Thus the line tends to assume a position wherein parallel sections are shielded from the prevailing breeze. Additionally, the hoist tends to assume an equilibrium position and ceases to rotate.

SUMMARY OF THE INVENTION

It is an object of this invention to provide a clothes hoist which does not suffer from the aforementioned disadvantages.

A further object is to provide a clothes hoist which is foldable, easily removed from a socket, light, and simply and economically constructed.

Thus this invention provides a foldable rotary clothes hoist having an upright support post rotatably mounted in a socket on a base member. A plurality of arms are pivotably connected at one end to the post and extend radially outwardly and an equal number of cooperating tension members are also secured pivotably to the post and are detachably connected to the arms when in operating position. Each arm is adapted to have a line detachably secured to it. The arms, tension members and lines are all capable of being folded down and the entire unit may be removed from the socket member.

BRIEF DESCRIPTION OF THE SEVERAL VIEWS OF THE DRAWINGS

The aforementioned characteristics and other advantages will become apparent when regard is had to the following description of a preferred embodiment when taken in conjunction with the accompanying drawings. It is emphasised that the particular structure illustrated is exemplary and not restrictive of the invention.

In the drawings.

DETAILED DESCRIPTION

Figure 2:
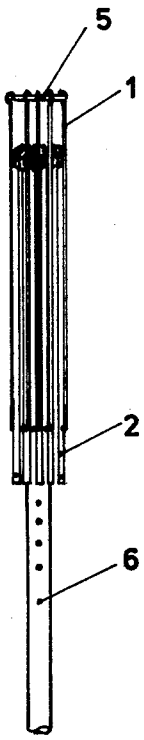
FIG. 2 is a view of the clothes hoist after removal.

Now having regard to the drawings, numeral 1 represents a tension member for an arm 2. Member 1 may be attached to a ring 5 fixed to the post 6 close to the top thereof and detachably connected to the side of arm 2 in any suitable way. The clothes line 4, which may be of a plastics material is fixed to a lower ring 11 secured to the post 6 and is adapted to be fitted into the end of arm 2 by an end connecting member 3. If desired the member 3 may be permanently fixed to the arm 2 by e.g. welding. The length of the line 4 is such that when operating is taut and properly tensioned. Arm 2 is preferably attached to post 6 by a hinge 10 which enables it to move freely in a vertical plane when tension member 1 is detached.

Figure 7:
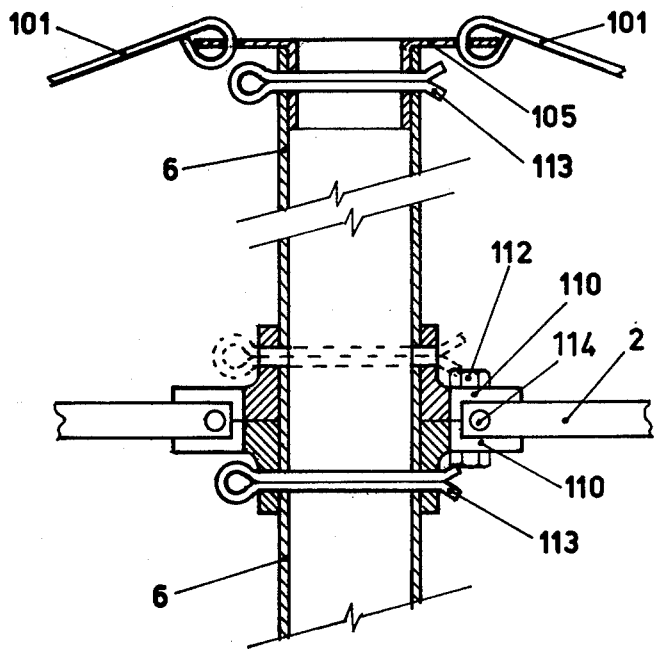
FIG. 7 is an elevational view of an alternative preferred embodiment of the upper portion of the hoist.
Figure 8:
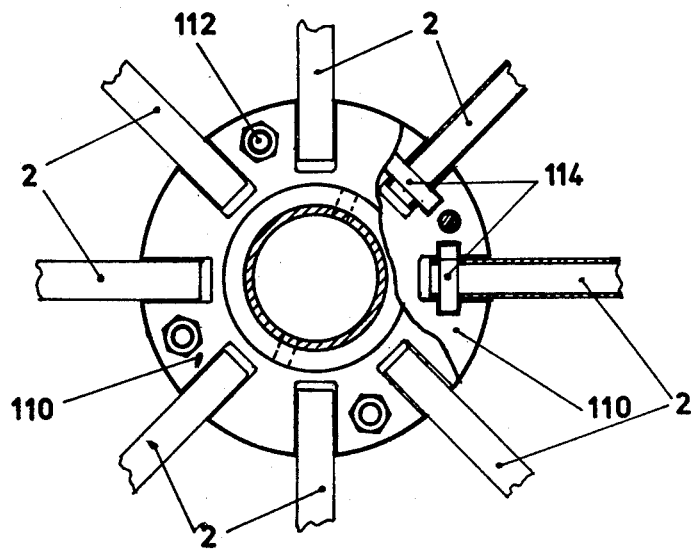
FIG. 8 is a plan view of FIG. 7.

In FIGS. 7 and 8, the tension member is indicated as 101 and is adapted to fold down over an arm 2 when released from the distal end of 2. It is shown attached onto a flanged member 105 which fits into the support post 6. As shown member 105 is secured in position by a split pin 113. If desired member 105 could fit over the post 6 and if desired be secured by other means, e.g. a bolt. A different arrangement for connecting the arm 2 is also shown. Two circular portions 110 are detachably secured together by locking means 112, e.g. they may be bolted or screwed and each is detachably secured to the main post 6 by fixed means 113, e.g. split pins or a bolt and nut. The arm 2 is pivotably attached to the ring 110 by pin 114 which allows it to fold freely when arm 101 is disconnected from its distal end.

The post 6 is mounted in a socket 9 and is provided with a number of holes 7 for adjusting the height of the line. The post may be secured in position by a pin 8. As can be seen the clothes hoist is free to rotate under the action of a current of air.

As indicated previously the clothes hoist is foldable or collapsible and this may be accomplished by removing the tension member 1 from the arm 2 which is then free to drop close to and approximately parallel to the post 6. The line 4 may be removed from the arm 2 by detaching the connecting member 3. The hoist may be removed from its socket 9 and stored away until needed — thereby making an area available for other activities.

If desired a suitable canvas or tarpaulin cover may be placed over the hoist so that in its working position it acts as a sun-umbrella. Additionally, a garden table may be so designed as to fit around the post 6.

Figure 1:
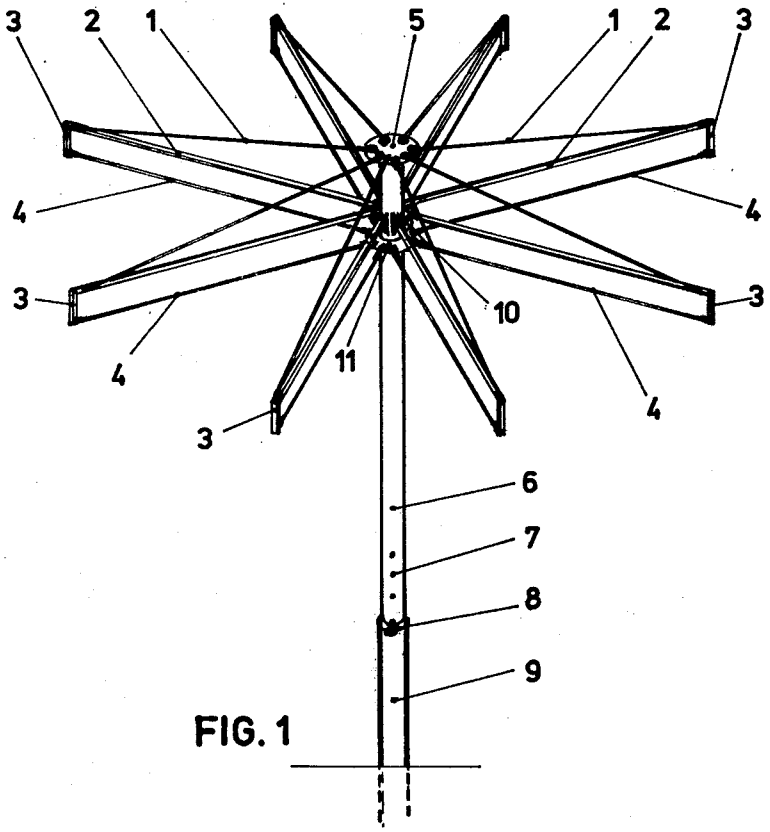
FIG. 1 is a perspective view of a clothes hoist in operating position.
Figure 4:
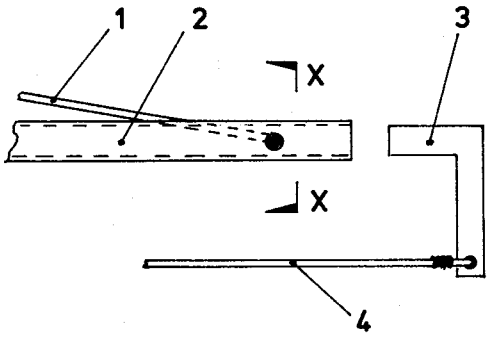
FIG. 4 shows the end detail of an arm.
Figure 6:
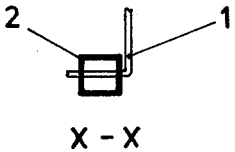
FIG. 6 is an end view of the arm through x - x of FIG. 4.
Figure 3:
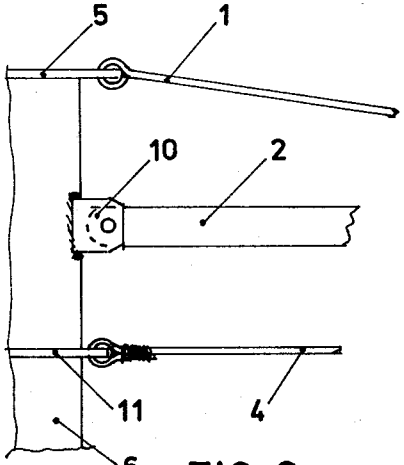
FIG. 3 is an elevational view showing detail of a hinge.
Figure 5:
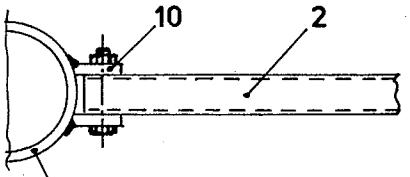
FIG. 5 is a plan view of the hinge of FIG. 4.

Whilst the hoist is shown with all arms raised in FIG. 1 and all arms lowered in FIG. 2, it should be realised that not all arms need to be raised when operating and that the hoist may be used if desired with only one arm in operating position.

It should be noted that as the clothes line is radial to the main post, the hoist will tend to rotate under the effect of a current of air and will not assume an equilibrium position. This will increase its drying effect.

It is not intended that this invention be limited to the particular structure shown. Thus the tension member 1 and the line 4 may be fitted to the post 6 in other ways. Similarly the tension member and line may be connected to the arm 2 in other ways and the arm 2 may be connected to the post 6 by other means. It is important that the tension member arm and line are so connected that they are adapted to move freely in a vertical plane so that the hoist may be folded or collapsed to a configuration as schematically shown in FIG. 2.

It may be mentioned that the tension member, arm and line may be fixed to a member (other than a post 6) such as a wall by a suitable means and operate as a clothes drying device.

The components used may be made of any suitable material and if desired galvanized to reduce corrosion. Desirably the total weight of the hoist should be kept as light as is compatible with safety. The main post 6 may be about 1½ inches diameter, the double ring 110 about 5 inches diameter and its flanged sections each ⅜ inch thick and the arms ⅝ inch diameter and about 6 feet long. A hoist of the above size can conveniently be positioned on a sun-deck or an outdoor area where space is at a premium and is easily folded down and removed when the area is required for other activities.

It is reiterated that the invention is to be given a broad connotation and is not confined to the embodiments described.

We claim:

1. A foldable rotary clothes hoist comprising:

(i) An upright support post rotatably mounted in a socket on a base member;

(ii) A plurality of arms, each connected at one end to said post and extending radially outwardly thereform; each of said plurality of arms being capable of upward and downward movement independently from the other arms;

(iii) A plurality of tension members, each associated with a respective arm and being connected at one end to said post above the connection point of its associated arm and at the other end detachably connected to the distal end of a respective arm;

(iv) A plurality of separate clothes line sections independent from said plurality of tension members, each connected at one end to said post and at the other end connected to a respective arm so as to extend radially beneath a respective arm;

(v) The connections of said tension members and said arms to said posts being pivotal and having pivot axes transverse to the longitudinal axis of said post whereby on detaching said tension members from said arms, said tension members, arms and clothes line sections are able to fold downwardly to lie alongside said post.

2. A foldable rotary clothes hoist as claimed in claim 1 wherein the tension members are connected to the periphery of a ring member secured to the post.

3. A foldable rotary clothes hoist as claimed in claim 2 wherein each said clothes line section is detachably secured to the distal end of its respective arm.

4. A foldable rotary clothes hoist as claimed in claim 2 wherein the socket is provided with means for varying the height of the support post.

5. A foldable rotary clothes hoist comprising:

(i) An upright support post rotatably mounted in a socket on a base member;

(ii) a flanged ring member detachably secured to and positioned around said support post, said flanged ring member being formed of two parts detachably secured together;

(iii) A plurality of arms, each secured at one end to the flanged portion of said ring member, said arms extending radially outwardly from said support post;

(iv) A plurality of tension members, each connected at one end to said post above the connection points of said arms, and at the other end detachably connected to a respective arm of said plurality of arms at or near the distal end thereof;

(v) A plurality of separate clothes line sections independent from said plurality of tension members, each connected at one end to said post and at the other end connected to a respective arm so as to extend radially beneath a respective arm;

(vi) The connections of said tension members to said post and said arms to said ring member being pivotal and having pivot axes transverse to the longitudinal axis of said post whereby on detaching said tension members from said arms, said tension members, arms and clothes line sections are able to fold downwardly to lie alongside said post.

6. A foldable rotary clothes hoist as claimed in claim 5 wherein the tension members are connected to a flanged ring detachably secured around the post.

7. A foldable rotary clothes hoist as claimed in claim 5 wherein each said clothes line section is detachably secured to the distal end of its respective arm.

8. A foldable rotary clothes hoist as claimed in claim 5 wherein the socket is provided with means for varying the height of the support post.

* * * * *